United States Patent [19]

Saad

[11] Patent Number: 4,642,585

[45] Date of Patent: Feb. 10, 1987

[54] SUPERELLIPTICAL WAVEGUIDE CONNECTION

[75] Inventor: Saad M. Saad, Willowbrook, Ill.

[73] Assignee: Andrew Corporation, Orland Park, Ill.

[21] Appl. No.: 696,439

[22] Filed: Jan. 30, 1985

[51] Int. Cl.[4] ..... H01P 1/16; H01P 5/08

[52] U.S. Cl. ..... 333/21 R; 333/34

[58] Field of Search ..... 333/21 R, 33–35, 333/254

[56] References Cited

U.S. PATENT DOCUMENTS

| | | | |
|---|---|---|---|
| 2,432,093 | 12/1947 | Fox | 333/35 X |
| 2,767,380 | 10/1956 | Zobel | 333/35 |
| 3,019,399 | 1/1962 | Lanciani et al. | 333/35 X |
| 3,293,573 | 12/1966 | Krank et al. . | |
| 3,336,543 | 8/1967 | Johnson et al. | 333/21 R X |
| 3,517,341 | 6/1970 | Augustin . | |
| 3,558,800 | 6/1971 | Wallis . | |
| 3,651,435 | 3/1972 | Riblet . | |
| 3,753,287 | 8/1973 | Ziemek et al. . | |
| 3,757,280 | 9/1973 | Staschewski . | |
| 3,777,045 | 12/1973 | Artbauer . | |
| 3,812,578 | 5/1974 | Prinzhorn . | |
| 3,860,891 | 1/1975 | Hiramatsu . | |
| 3,867,708 | 2/1975 | Bretting . | |
| 3,918,010 | 11/1975 | Marchalot . | |
| 3,928,825 | 12/1975 | Kaffenberger et al. . | |
| 3,974,467 | 8/1976 | Tobita et al. . | |
| 3,993,966 | 11/1976 | Reindel . | |
| 4,025,878 | 5/1977 | Predmore . | |
| 4,143,930 | 3/1979 | Schauer . | |
| 4,215,559 | 8/1980 | Kuypers . | |
| 4,282,458 | 8/1981 | Barnett . | |
| 4,353,041 | 10/1982 | Bryans . | |
| 4,366,457 | 12/1982 | Bode et al. . | |
| 4,369,911 | 6/1983 | Blumenberg . | |
| 4,540,959 | 9/1985 | Saad | 333/21 R |

OTHER PUBLICATIONS

Bulley, "Analysis of the Arbitrarily Shaped Waveguide by Polynomial Approximation", *IEEE Transactions on Microwave Theory & Techniques,* Dec. 1970.

Bandler, "Computer Optimization of Inhomogeneous Waveguide Transformers", *IEEE Transactions on Microwave Theory . . . ,* Aug. 1969.

Pontoppidan, "Numerical Solution of Waveguide Problems Using Finite Difference Methods," *European Microwave Conference,* London, Sept. 1969.

Larsen, "Superelliptic & Related Coordinate Systems", *European Microwave Conference,* London, Sep. 1969.

*Primary Examiner*—Paul Gensler

*Attorney, Agent, or Firm*—Leydig, Voit & Mayer

[57] ABSTRACT

A waveguide connection comprising the combination of a rectangular waveguide, an elliptical waveguide having a cutoff frequency and impedance different from those of said rectangular waveguide, an inhomogeneous stepped transformer joining said rectangular waveguide to said elliptical waveguide, said transformer having multiple sections all of which have inside dimensions small enough to cutoff the first excitable higher order mode in a preselected frequency band, each section of said transformer having a transverse cross-section defined by the equation: $(2x/a)^p+(2y/b)^p=1$, where a is the dimension of the inside surface of said cross-section along the major transverse axis, b is the dimension of the inside surface of said cross-section along the minor transverse axis, and x and y define the location of each point on the inner surface of the cross-section with reference to the coordinate system established by the major and minor transverse axes of the cross-section, respectively, the value of said exponent p increasing progressively from the section adjacent to said elliptical waveguide to the section adjacent to said rectangular waveguide, and the magnitudes of a and b changing progressively from step to step along the length of said transformer so that both the cutoff frequency and the impedence of said transformer change monotonically along the length of said transformer.

5 Claims, 7 Drawing Figures

SUPERELLIPTICAL WAVEGUIDE CONNECTION

CROSS-REFERENCE TO RELATED APPLICATION

Saad U.S. patent application Ser. No. 554,178, filed Nov. 22, 1983 for "Rectangular to Elliptical Waveguide Connection" now U.S. Pat. No. 4,540,959.

TECHNICAL FIELD

The present invention relates to inhomogeneous waveguide connectors for use in connecting generally rectangular waveguides to generally elliptical waveguides. An "inhomogeneous" waveguide connector is defined as a connector used for joining waveguides having different cutoff frequencies.

DESCRIPTION OF THE INVENTION

A primary object of the present invention is to provide an improved inhomogeneous waveguide connector for joining a rectangular waveguide to an elliptical waveguide, and which provides a low return loss over a wide bandwidth.

A further object of this invention is to provide such an improved connector which can be manufactured with relatively large cutting tools, thereby permitting fine machine tolerances to be maintained.

A still further object of this invention is to provide such an improved waveguide connector which has a very low return loss but does not have tuning devices (screws, etc.) that reduce the power-handling capacity of the connector.

Another object of the invention is to provide an improved waveguide connector of the foregoing type which utilizes a stepped transformer, and which is characterized by a return loss which decreases as the number of steps is increased.

A still further object of this invention is to provide such an improved waveguide connector having a relatively short length.

Other objects and advantages of the invention will be apparent from the following detailed description and accompanying drawings.

In accordance with the present invention, the foregoing objectives are realized by providing a waveguide connection comprising the combination of a rectangular waveguide, an elliptical waveguide having a cutoff frequency and characteristic impedance different from those of the rectangular waveguide, and an inhomogeneous stepped transformer joining the rectangular waveguide to the elliptical waveguide, the transformer having multiple sections all of which have inside dimensions small enough to cut off the first excitable higher order mode in a preselected frequency band, each section of the transformer having a superelliptical cross section defined by the following equation:

$$(2x/a)^p+(2y/b)^p=1$$

where a is the dimension of the inside surface of said cross-section along the major transverse axis, b is the dimension of the inside surface of said cross-section along the minor transverse axis, x and y define the location of each point on the inner surface of the cross-section with reference to the coordinate system established by the major and minor transverse axes of the cross section respectively, the value of the exponent p increasing progressively from the section adjacent the elliptical waveguide to the section adjacent the rectangular waveguide, the magnitudes of a and b changing progressively from step to step along the length of the transformer so that both the cutoff frequency and the impedance of the transformer change monotonically along the length of the transformer.

Figure 1:
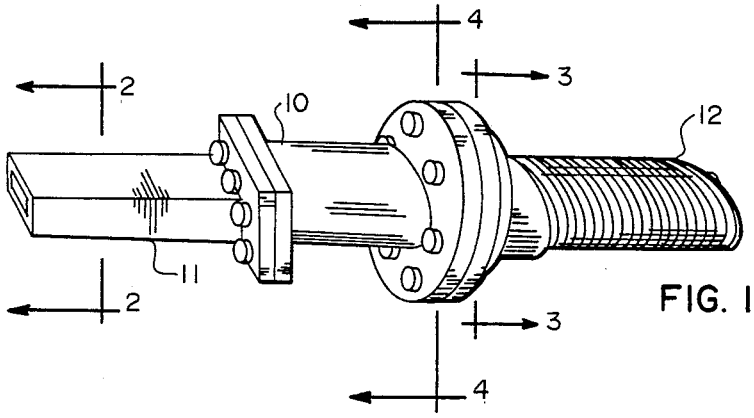
FIG. 1 is a partial perspective view of a waveguide connection employing the present invention.

While the invention is susceptible to various modifications and alternative forms, a specific embodiment thereof has been shown by way of example in the drawings and will be described herein. It should be understood, however, that it is not intended to limit the invention to the particular form disclosed. On the contrary, the intention is to cover all modifications, equivalents, and alternatives following within the spirit and scope of the invention as defined by the appended claims.

DESCRIPTION OF THE PREFERRED EMBODIMENTS

Figure 2:
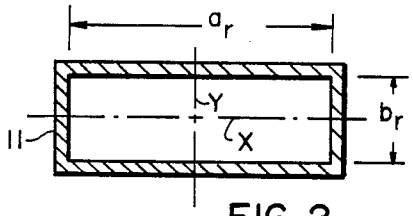
FIG. 2 is a section taken generally along line 2—2 in FIG. 1.
Figure 3:
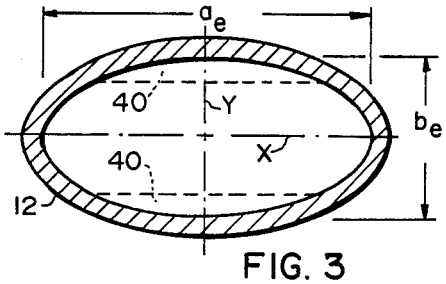
FIG. 3 is a section taken generally along line 3—3 in FIG. 1.
Figure 5:
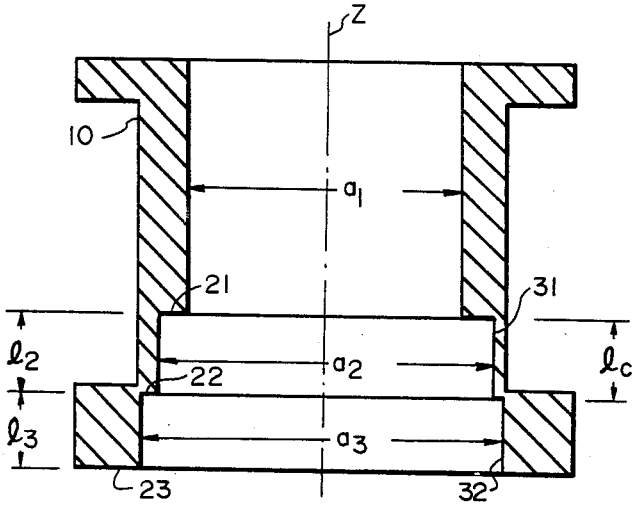
FIG. 5 is a section taken generally along line 5—5 in FIG. 4.
Figure 4:
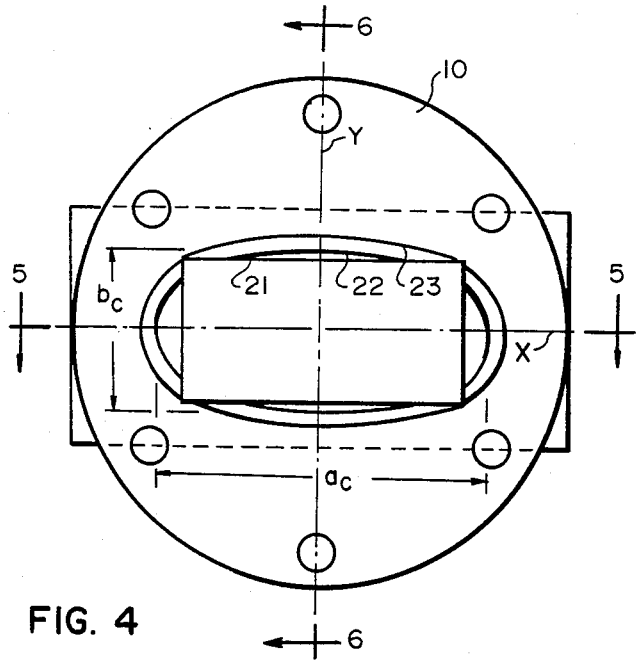
FIG. 4 is an enlarged view taken generally along line 4—4 in FIG. 1.
Figure 6:
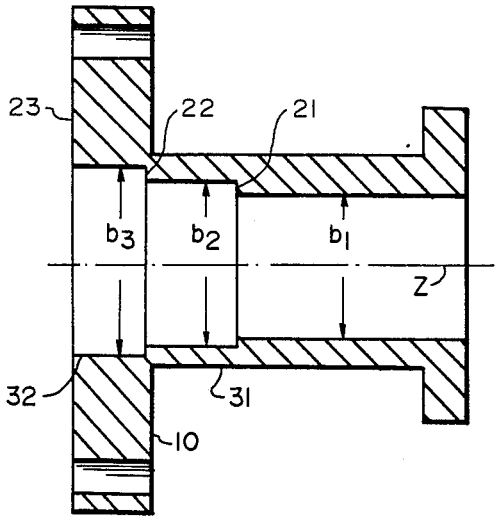
FIG. 6 is a section taken generally along line 6—6 in FIG. 4.

Turning now to the drawings and referring first to FIG. 1, there is shown a connector 10 for joining a rectangular waveguide 11 to an elliptical waveguide 12. The transverse cross-sections of the rectangular waveguide 11 and the elliptical waveguide 12 are shown in FIGS. 2 and 3, respectively, and the transverse and longitudinal cross-sections of the connector 10 are shown in FIGS. 4–6. The connector 10, the rectangular waveguide 11 and the elliptical waveguide 12 all have elongated transverse cross-sections which are symmetrical about mutually perpendicular major and minor transverse axes x and y.

The rectangular waveguide 11 has a width $a_r$ along the x axis and a height $b_r$ along the y axis, while the elliptical waveguide 12 has a maximum width $a_e$ and a maximum height $b_e$ along the same axes. As is well known in the waveguide art, the values of $a_r$, $b_r$ and $a_e$, $b_e$ are chosen according to the particular frequency band for which the waveguide is to be used. These dimensions determine the characteristic impedance $Z_c$ and cutoff frequency $f_c$ of the waveguides 11 and 12. For example, type-WR137 rectangular waveguide has a cutoff frequency $f_c$ of 4.30 GHz. Corresponding cutoff frequency values for other rectangular waveguide sizes are well known in the art. Elliptical waveguides, however, are not universally standardized because the depth of the corrugations also affects the cutoff frequency $f_c$, and each individual manufacturer determines what that depth will be.

As can be seen in FIGS. 4–6, the connector 10 includes a stepped transformer for effecting the transition between the two different cross-sectional shapes of waveguides 11 and 12. In the particular embodiment illustrated in FIGS. 4–6, the transformer includes three steps 21, 22 and 23, associated with two sections 31 and 32, though it is to be understood that a greater or smaller number of steps may be used for different applications. Each of the two sections 31 and 32 has transverse dimensions which are large enough to propagate the desired mode therethrough, but small enough to cut off the first excitable higher order mode. For any given cross sectional configuration, the upper limit on the transverse dimensions required to cut off higher order modes can be calculated by using the numerical method described in R. M. Bulley, "Analysis of the Arbitrarily Shaped Waveguide by Polynomial Approximation", *IEEE Transactions on Microwave Theory and Techniques,* Vol. MTT-18, No. 12, December 1970, pp. 1022–1028.

The transverse dimensions $a_c$ and $b_c$ of the successive sections 31 and 32, as well as the longitudinal length $l_c$ of each respective section, are also chosen to minimize reflection at the input end of the connector 10 over the prescribed frequency band for which the connector 10 is designed. The particular dimensions required to achieve this minimum reflection can be determined empirically or by computer optimization techniques, such as the razor search method (J. W. Bandler, "Computer Optimization of Inhomogeneous Waveguide Transformers", *IEEE Transactions on Microwave Theory and Techniques,* Vol. MTT-17, No. 8, August 1969, pp. 563–571), solving for the known reflection equation: Reflection Coefficient $=(Y_{co}-Y_{in}-jB_1)/(Y_{co}+Y_{in}+jB_1)$. The sections 31 and 32 can have the same longitudinal electrical length, although this is not required.

In accordance with one important aspect of the present invention, the inhomogeneous stepped transformer in the rectangular-to-elliptical connector has a generally super-elliptical interior cross-section which changes progressively from step to step along the length of the transformer, in the direction of both the x and y axes, and which also has an exponent p of the form:

$$(2x/a)^p+(2y/b)^p=1$$

where $p \geqq 2$. Each cross-section progressively varies in the same longitudinal direction, such that both the cutoff frequency and the impedance of the transformer vary monotonically along the length of the transformer. Because each step of the transformer has a super-elliptical cross-section, the exponent p is, by definition, greater than or equal to two at every step. The exponent p has its maximum value at the end of the connector to be joined to the rectangular waveguide so that the transverse cross-section of the connector most closely approaches a rectangle at that end. The exponent p has its minimum value at the end of the connector to be joined to the elliptical waveguide, though it is not necessary that the exponent be reduced to two at the elliptical end; that is, there can be a step between the elliptical waveguide and the adjacent end of the connector.

At the rectangular waveguide end of the connector 10, the width $a_1$ and height $b_1$ of the connector are the same as the width $a_r$ and height $b_r$ of the rectangular waveguide 11. At step 23, the elliptical waveguide end of the connector 10, the width $a_3$ and height $b_3$ of the connector 10 are smaller than the width $a_e$ and height $b_e$ of the elliptical waveguide by increments comparable to the average incremental increases of $a_c$ and $b_c$ at steps 21 and 22.

Either a capacitive iris 40 (as shown in phantom in FIG. 3) or an inductive iris (not shown, but identical to the capacitive iris except that it is parallel to the minor transverse axis y) may be provided at the elliptical waveguide end of the connector to expand the bandwidth and/or provide an improved return loss. The effect of such an iris is well known in the art, and is generally described in L. V. Blake, Antennas (1966).

By varying the internal transverse dimensions of the successive sections of the inhomogeneous transformer along both the major and minor transverse axes x and y ($a_c$, $b_c$ vary according to possibilities of $f_c$ (EW) $f_c$ (WR)) while varying the value of the exponent p (p changes systematically from 2 for an elliptical waveguide (EW) to $\infty$ for a rectangular waveguide (WR)), both the cutoff frequency $f_c$ and the impedance $Z_c$ can be predetermined to vary monotonically along the length of the transformer. This provides a good impedance match between the transformer and the different waveguides connected thereby, resulting in a desirably low return loss (VSWR) across a relatively wide frequency band.

This invention is in contrast to prior art rectangular-to-elliptical waveguide connectors using inhomogeneous stepped transformers in which the transverse cross section was varied only along the minor transverse axis. In such a transformer, the variation in cutoff frequency along the length of the transformer is not monotonic, increasing at one or more steps of the transformer and decreasing in one or more other steps, and leading to a relatively high return loss. Superelliptical cross-sections have been previously used in smooth-walled (non-stepped) homogeneous (constant cutoff frequency) transitions between rectangular and circular waveguides, with only mediocre results (T. Larsen, "Superelliptic Broadband Transition Between Rectangular and Circular Waveguides," *Proceedings of European Microwave Conference,* Sept. 8–12, 1969, pp. 277–280). Thus, it is surprising that the superelliptical cross-section produces such outstanding results in the stepped, inhomogeneous, rectangular-to-elliptical connector of the present invention.

The invention also is a significant advancement over the prior art from the manufacturing viewpoint. At particularly high frequencies (e.g., 22 GHz), the characteristic dimensions of waveguide connectors (and waveguides in general) must be small, and hence difficult to manufacture when the inner surfaces of the connector contain small radii. Further, at these frequencies, the tolerances become more critical in that they represent a greater fraction of a wavelength. At these frequencies, therefore, step transformers with rectangular cross-sections become increasingly difficult to manufacture by machining because the milling operations necessarily leave small radii at any location where vertical and horizontal surfaces join. With the superelliptical cross-section, however, the connector can be economically manufactured by machining because no small radii are required. Though one end of the connector has a rectangular cross-section, that portion of the connector can be easily formed by a single broaching operation before the other steps are milled.

Figure 7:
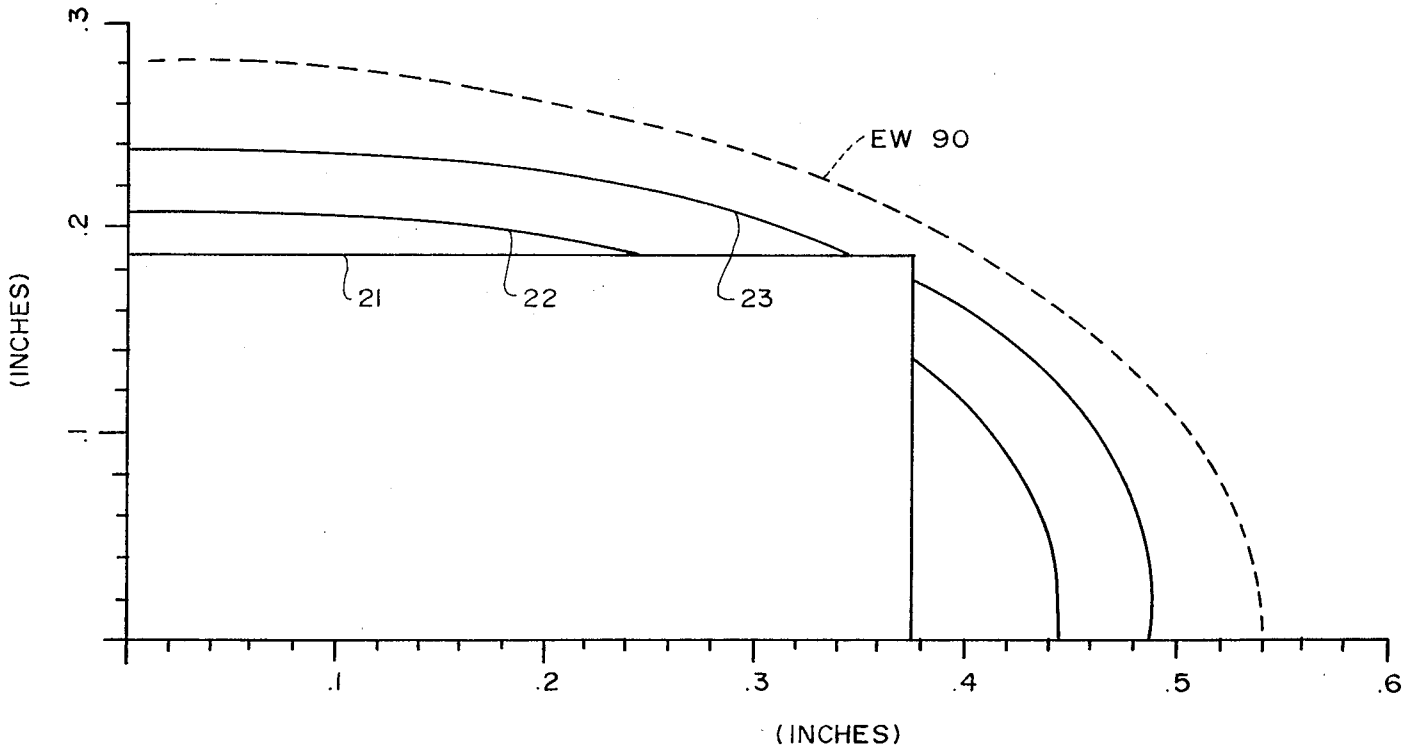
FIG. 7 is a graphical depiction of the dimensions of the various transverse cross-sections in the waveguide transition used in the connection of FIG. 1.

One working example of the embodiment of FIGS. 4–6 is shown in FIG. 7. This particular example has a three-section transformer designed for joining type-WR75 rectangular waveguide to type-EW90 corrugated elliptical waveguide, the two sections 31 and 32 of the connector which form the steps 21, 22 and 23 have superelliptical cross-sections with exponents p of 2.55 and 2.45, respectively, and the following dimensions (in inches):

Section 31—$a_2=0.892$, $b_2=0.424$, $l_2=0.350$

Section 32—$a_3=0.978$, $b_3=0.504$, $l_3=0.445$

Type-WR75 rectangular waveguide is designed for a cutoff frequency of 7.868 GHz and has a width $a_r$ of 0.75 inches and a height br of 0.375 inches. Type-EW90 corrugated elliptical waveguide is designed for a cutoff frequency of 6.5 GHz and has a major dimension $a_e$ of 1.08 inches and a minor dimension $b_e$ of 0.56 inches ($a_e$ and $b_e$ are measured by averaging the corrugation depth). In an actual test over the band 10.7 to 11.7 GHz, this particular connector produced a return loss (VSWR) ranging from −38 dB to −45.7 dB when a tab flare (not shown) was used on the EW90, and ranging from −42 dB to −49 dB when a tool flare (not shown) was used. As is conventional and well known in the art, a tab flare comprises an extension of the elliptical waveguide end having a plurality of outwardly bent tabs separated by longitudinal slits, while a tool flare comprises a continuous extension of the elliptical waveguide end which is stretch flared by means of a tool mechanism.

As can be seen from the foregoing detailed description, this invention provides an improved waveguide connector for joining rectangular waveguide to elliptical waveguide, while providing low return loss over a wide bandwidth. This connector is relatively easy to fabricate by machining so that it can be efficiently and economically manufactured with fine tolerances without costly fabrication techniques such as electroforming and the like. Furthermore, this connector provides low return loss without comprising tuning devices, and therefore, the large power-handling capacity and the low production costs of the connector are maintained. Since the connector utilizes a step transformer, the return loss decreases as the number of steps are increased so that the connector can be optimized for minimum length or minimum return loss, or any desired combination thereof, depending on the requirements of any given practical application.

I claim as my invention:

1. A waveguide connection comprising the combination of a rectangular waveguide, an elliptical waveguide having a cutoff frequency and impedance different from those of said rectangular waveguide, an inhomogeneous stepped transformer joining said rectangular waveguide to said elliptical waveguide, said transformer having multiple sections all of which have inside dimensions small enough to cut off the first excitable higher order mode in a preselected frequency band, each section of said transformer having a transverse cross-section defined by the following equation:

$$(2x/a)^p+(2y/b)^p=1$$

where a is the dimension of the inside surface of said cross-section along the major transverse axis, b is the dimension of the inside surface of said cross-section along the minor transverse axis, and x and y define the location of each point on the inner surface of the cross-section with reference to the coordinate system established by the major and minor transverse axes of the cross-section, respectively, the value of said exponent p increasing progressively from the section adjacent to said elliptical waveguide to the section adjacent to said rectangular waveguide, the magnitudes of p, a and b changing progressively from step to step along the length of said transformer so that both the cutoff frequency and the impedance of said transformer change monotonically along the length of said transformer.

2. A waveguide oonnection as claimed in claim 1 wherein said cutoff frequency of said transformer progressively increases from the waveguide with the lower cutoff frequency toward the waveguide with the higher cutoff frequency.

3. A waveguide connection as set forth in claim 1 wherein said impedance of said transformer progressively increases from the waveguide with the lower impedance towards the waveguide with the higher impedance.

4. A waveguide connection as set forth in claim 1 which includes a capacitive iris at the end of said transformer adjacent to said elliptical waveguide.

5. A waveguide connection as set forth in claim 1 which includes an inductive iris at the end of said transformer adjacent to said elliptical waveguide.

* * * * *